US005560113A

United States Patent [19]

Simo et al.

[11] Patent Number: 5,560,113

[45] Date of Patent: *Oct. 1, 1996

[54] BOWSIGHT

[75] Inventors: Miroslav A. Simo, Riverside, Ill.; Russel H. Barngrover, Crestline, Calif.

[73] Assignee: New Archery Products Corp., Forest Park, Ill.

[ * ] Notice: The term of this patent shall not extend beyond the expiration date of Pat. No. 5,419,051.

[21] Appl. No.: 451,916

[22] Filed: May 26, 1995

Related U.S. Application Data

[63] Continuation-in-part of Ser. No. 266,248, Jun. 27, 1994, Pat. No. 5,419,051.

[51] Int. Cl.[6] ..... F41G 1/32; F41G 1/467

[52] U.S. Cl. ..... 33/265; 33/241; 124/87

[58] Field of Search ..... 33/265, 241; 124/87

[56] References Cited

U.S. PATENT DOCUMENTS

| | | | |
|---|---|---|---|
| 2,654,152 | 10/1953 | LaVire | 33/265 |
| 3,670,422 | 6/1972 | Stebbins et al. | 33/265 |
| 3,945,127 | 3/1976 | Spencer | 33/265 |
| 4,177,572 | 12/1979 | Hindes | 33/265 |
| 4,928,394 | 5/1990 | Sherman | 33/265 |
| 5,168,631 | 12/1992 | Sherman | 33/265 |
| 5,174,269 | 12/1992 | Sappington | 33/265 |
| 5,201,124 | 4/1993 | Sherman | 33/265 |
| 5,220,907 | 6/1993 | Longsdale | 33/265 |
| 5,228,204 | 7/1993 | Khoshnood | 33/265 |
| 5,231,765 | 8/1993 | Sherman | 33/265 |
| 5,419,051 | 5/1995 | Barngrover | 33/265 |
| 5,442,861 | 8/1995 | Lorocco | 33/265 |

*Primary Examiner*—Christopher W. Fulton
*Attorney, Agent, or Firm*—Speckman, Pauley & Fejer

[57] ABSTRACT

A bowsight for attachment to a bow. The bowsight has a crosswire frame which is supported by a bracket held to the bow. A pin slide is formed in an inner frame member and has a cylindrical opening. The pins can emit light and are mounted in transparent discs which slide into the cylindrical opening and which are tightened by an Allen screw against a slot in the disc, thereby expanding the disc against the side of the pin slot. The transparent disc gathers surrounding light and transmits or directs the light to the light-emitting pin. A lens or a light-emitting source can be positioned in the cylindrical opening to surround the transparent disc with light. The crosswire frame may be incrementally moved up and down with respect to the bracket by locking a spring-loaded ball bearing in any one of a plurality of detents in the frame. The spring-loaded ball bearing may be forcibly engaged so that the spring is completely compressed thereby locking the ball bearing in a chosen detent.

10 Claims, 5 Drawing Sheets

BOWSIGHT

This application is a continuation-in-part of earlier filed application, Ser. No. 08/266,248, filed 27 Jun. 1994, now U.S. Pat. No. 5,419,051.

BACKGROUND OF THE INVENTION

1. Field of the Invention

The field of this invention is archery and the invention relates more particularly to bowsights for improving the aim of the archer.

2. Description of Prior Art

Bowsights are well known and numerous patents have been granted therefor. One such bowsight is shown in Topel, U.S. Pat. No. 4,136,462 which has a plurality of adjustable pins in a bowsight frame. This bowsight has a number of knurled knobs that extend outwardly therefrom which potentially can catch on underbrush and the like and therefore a more compact and streamlined sight would be useful.

SUMMARY OF THE INVENTION

It is one object of this invention to provide a compact bowsight with adjustable light-emitting pins.

It is another object of this invention to provide a compact bowsight with adjustable light-emitting pins in which a luminosity of the light-emitting pins can be varied.

It is yet another object of this invention to provide a compact bowsight with an inner frame member that can be adjusted upwardly and downwardly in discrete increments and yet may be locked in a desired position.

These and other objects of this invention are achieved with a bowsight that has a bracket which is detachably secured with respect to the bow and a reticle support frame held by the bracket. The support frame has an inner frame member and a pin slide is formed in the inner frame member. The pin slide is preferably a cylindrical opening which extends vertically from the bottom of the inner frame member to near the top thereof and an elongated pin slot extends toward the center of the sight. An Allen screw access slot is formed in the rear of the bowsight and intersects the cylindrical opening. A plurality of sliding pin block discs are held in the pin slide. Each pin block disc has a bowsight pin extending outwardly therefrom into the central area of the bowsight. Each pin block disc has an Allen screw opening which can be accessed with an Allen screw through the Allen screw access slot. Each pin block disc has a threaded Allen screw opening which extends to an expansion slot so that insertion of the Allen screw expands the circumferential size of a pin block disc securing it against the cylindrical opening in the inner frame member. It is apparent to those skilled in the art that other known screw types can be used in place of the Allen screw that is referred to throughout this specification. The pin block disc is secured such that it does not in any way mar the vertical cylindrical openings so that small adjustments may be made in the height of each pin block disc. The reticle support frame is preferably held to the bracket by a dovetail slide attachment which has a plurality of detents formed in the center of the dovetail connection on the inner frame member. A bracket cross piece has a threaded opening ending in a spring and ball containing opening and the ball bearing may be tightened against the detents in the dovetail slide attachment. The size of the spring is selected so that when the threaded rod in the bracket cross piece is fully tightened the spring is fully compressed and, therefore, holds the ball bearing in a selected detent thereby preventing any movement. The sight may be set up as a pin setup or as a crosshair setup with either pins or wires held by the sliding pin block discs.

According to one preferred embodiment of this invention, a light-gathering end portion of a light-emitting bowsight pin is positioned in a transparent sliding pin block disc. The pin block disc collects surrounding light and transmits the collected light through the light-emitting pin. The cylindrical opening can extend through the top of the inner frame member, thus forming a bore in the top of the inner frame member. A lens can be positioned in the cylindrical opening to focus light entering the cylindrical opening and thus increase the light surrounding the pin block disc.

According to another preferred embodiment of this invention, a light-emitting source, such as a light-emitting diode, is positioned in the cylindrical opening. Such light-emitting source provides surrounding light for the pin block disc even in low-light conditions, such as when an archer is hunting. The pin block disc collects the surrounding light and transmits such light to the light-emitting pin, providing a luminous bowsight for an archer even in low-light conditions.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

As used throughout the specification and claims, the word transparent refers to light-permeable substances, including transparent and translucent substances.

Figure 1:
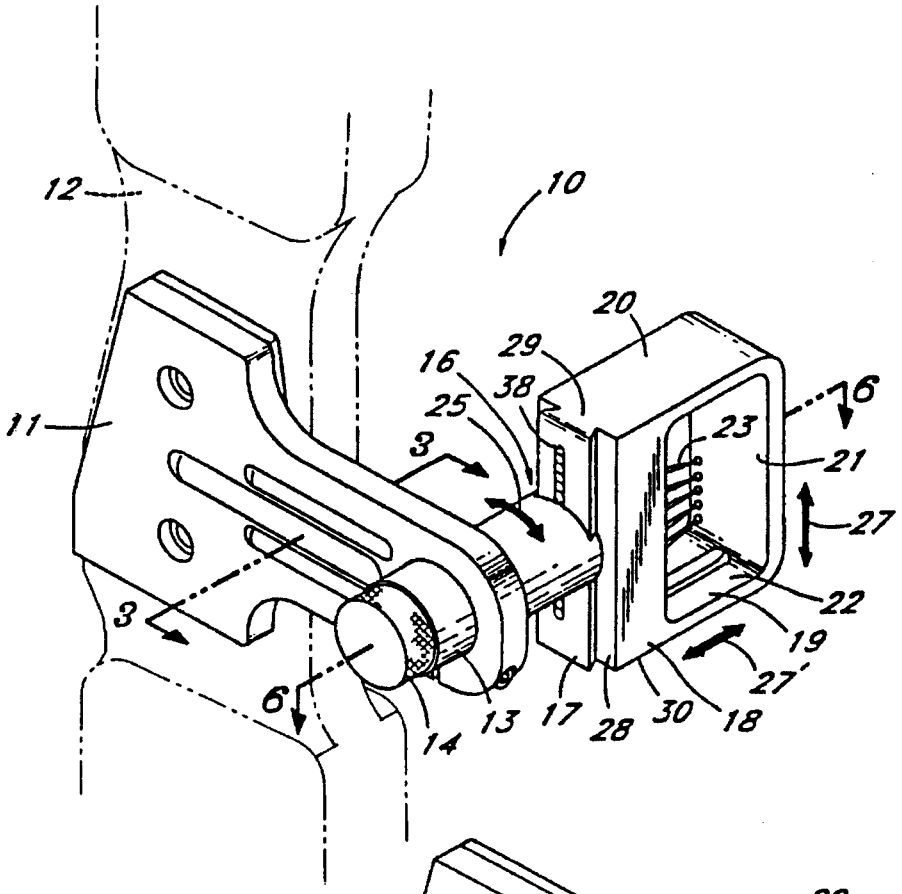
FIG. 1 is a perspective view of the bowsight attached to a portion of a bowriser shown in phantom lines, according to one preferred embodiment of this invention.
Figure 2:
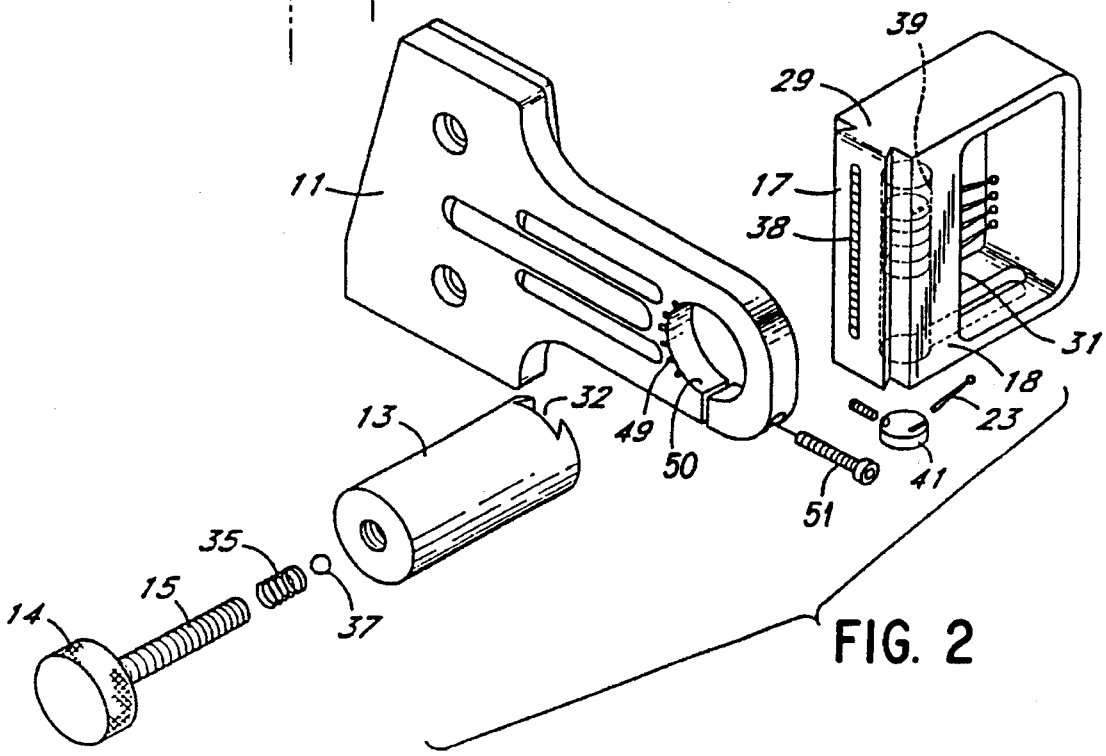
FIG. 2 is an exploded perspective view of the bowsight shown in FIG. 1.

FIG. 1 shows the bowsight of the present invention indicated generally by element reference numeral 10. The bowsight 10 has a bracket which comprises a bracket member 11 affixed to a bow 12 which is shown in phantom lines. A bracket cross piece 13 is adjustably affixed to the bracket member 11 and includes a knurled knob 14 affixed to a threaded rod 15, as shown in FIG. 2, to secure the bowsight assembly in a desired position. The means of securement will be described below.

Figure 3:
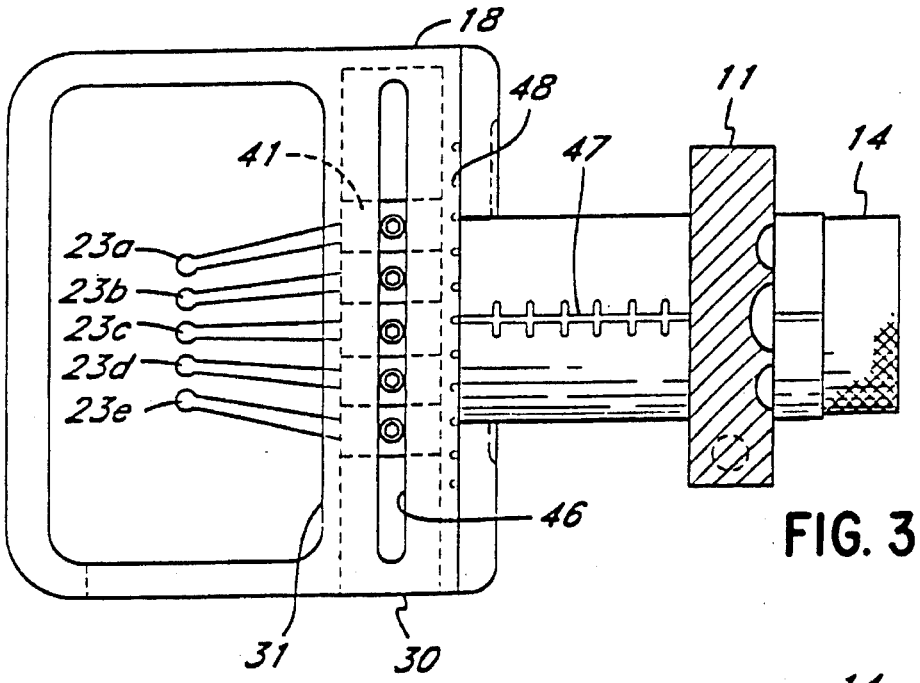
FIG. 3 is a partial cross-sectional view taken along line 3—3 of FIG. 1 showing the bowsight as a pin setup.
Figure 4:
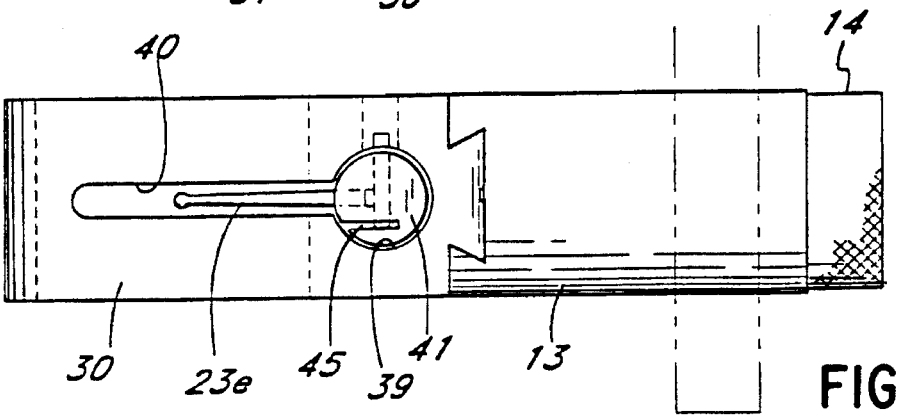
FIG. 4 is a top view of the bowsight shown in FIG. 1.
Figure 5:
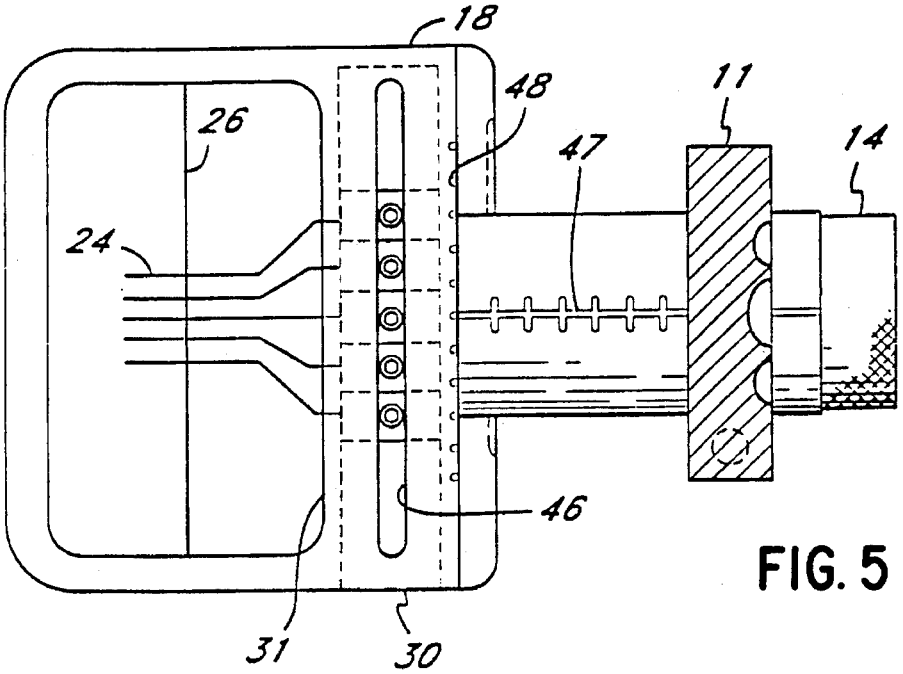
FIG. 5 is a partial cross-sectional view taken along line 3—3 of FIG. 1 showing a crosshair setup of the bowsight, according to another preferred embodiment of this invention.

A dovetail slide attachment 16 has a dovetail bar 17 on an inner frame member 18 of a reticle support frame 19. The reticle support frame 19 has a top frame member 20, an outer frame member 21 and a bottom frame member 22. These frame members protect a plurality of bowsight pins 23, as shown in FIGS. 3 and 4, or wires 24, as shown in FIG. 5, which also includes a crosshair 26.

The attachment of the reticle support frame assembly to the bracket member 11 via the bracket cross piece 13 is shown best in FIG. 2 where it can be seen that the bracket member 11 has a circular clamp portion 50 which is tightened by a screw 51 against the cylindrical bracket cross piece 13. This arrangement permits the reticle support frame 19 to be rotated as indicated by the arrow or moved inwardly and outwardly in an axial direction as indicated by the arrow 27'. The reticle support frame 19 may also be moved upwardly and downwardly as shown by the arrow 27 by using the dovetail slide attachment 16.

Figure 6:
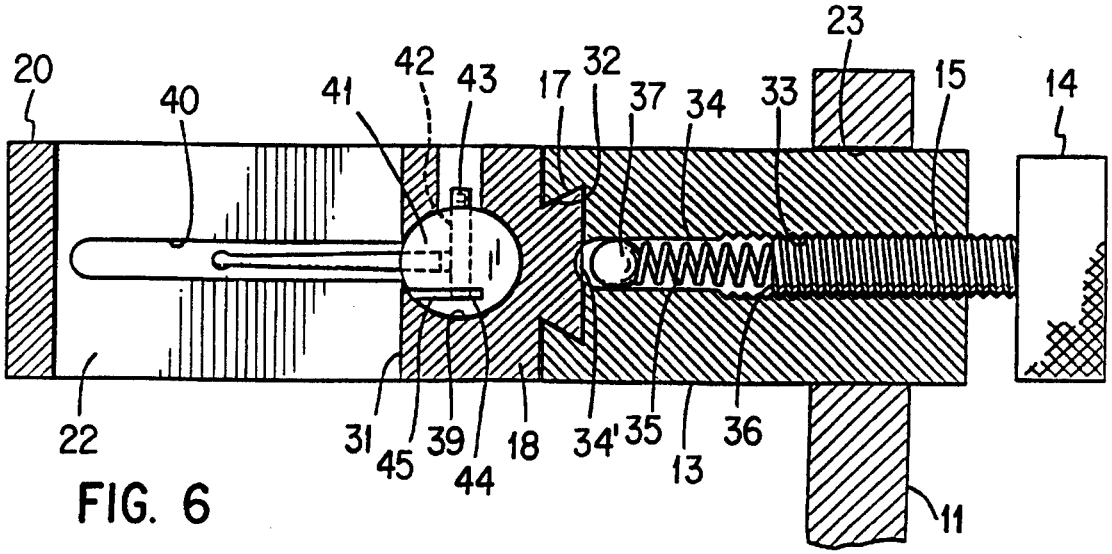
FIG. 6 is a partial cross-sectional view taken along 6—6 of FIG. 1 showing the dovetail attachment of the bowsight in an unlocked position.

The dovetail slide attachment 16 utilizes a dovetail bar 17 which is attached to an inner edge 28 of the inner frame member 18. The inner frame member 18 has a top 29, a bottom 30 and an outer edge 31 shown best in FIGS. 2, 3 and 4. The dovetail bar 17 fits in a sliding manner into a dovetail slot 32 in the bracket cross piece 13. It is apparent that the locations of the dovetail bar 17 and the dovetail slot 32 can be interchanged. The interior of the bracket cross piece 13 is shown best in FIGS. 6 and 7. In FIG. 6 the bracket cross piece 13 has a threaded opening 33 into which the threaded rod 15 engageably mates. A spring holding cylinder 34 houses a spring 35 which abuts an end 36 of the threaded rod 15. The opposite end of the spring 35 contacts the ball bearing 37 which may move in and out any one of a plurality of the detents 38, shown best in FIG. 2. Although the number of detents 38 is variable the detents 38 should be positioned close enough together so that the reticle support frame 19 may be moved up and down in relatively small increments. It should also be noted in FIGS. 6 and 7 that the spring holding cylinder 34 has a reduced end 34' to retain the ball bearing 37 in the spring holding cylinder 34.

Figure 7:
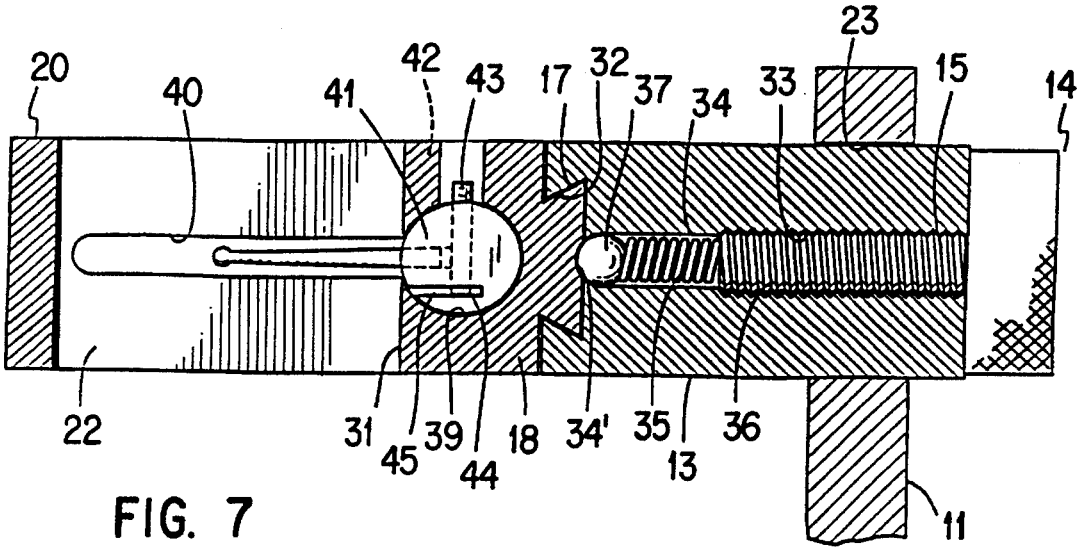
FIG. 7 is a partial cross-sectional view taken along line 6—6 of FIG. 1 showing the dovetail attachment of the bowsight in a locked position.

An interesting feature of this assembly is that the spring 35 is selected so that it may be completely compressed, as shown in FIG. 7, by fully rotating a knurled knob 14 thereby forming an inelastic holding assembly forcing the ball bearing 37 in a selected detent 38 so that the holding assembly will not be accidentally moved when bumped. Then in order to adjust the height of the frame, one merely loosens the knurled knob 14, as shown in FIG. 6, and the frame may be moved up and down in increments as the ball bearing 37 moves in and out of the individual detents 38. This provides an incremental movement which is much easier to adjust than a smooth slide.

Another relatively important feature of the present invention is the manner in which the bowsight pins 23 or the wires 24 are adjustably held in the reticle support frame 19. As shown in FIGS. 2 through 7, the inner frame member 18 has a cylindrical pin slide 39 which extends from the bottom 30 of the inner frame member 18 to near the top 29. In addition, a pin slot 40 is formed through the bottom frame member 22 which permits the insertion of a sliding pin block disc 41 with an attached bowsight pin 23, which is preferably secured by an adhesive in a permanent manner to the sliding pin block disc 41. It is apparent to those skilled in the art that the pin slot 40 and the pin block disc 41 can comprise any suitable cross section, including a circular cross section as shown in FIG. 2. A threaded Allen screw opening 42, shown best in FIGS. 6 and 7, holds an Allen screw 43. The Allen screw 43 is screwed into the sliding pin block disc 41 after being inserted in the pin slide 39 since the Allen screw access slot 46 does not extend to the bottom 30 of the inner frame member 18. Thus, more than one but typically five bowsight pins 23 may be inserted into the bowsight 10 and tightened at a desired position and separation. As is often the case, the individual sliding pin block discs 41 and bowsight pins 23 may be fabricated so that the bowsight pin 23 is at a different angle with respect to the sliding block disc 41. This is shown best in FIG. 3 where it can be seen that the bowsight pin **23*a* has a different angle with respect to a corresponding sliding pin block disc 41 than does any of the other bowsight pins 23*b*, 23*c*, 23*d* and 23*e*. Similarly, the wires 24 shown in FIG. 5** each have a different configuration so that they may be positioned very close together for higher speed bows.

The method of tightening an individual sliding pin disc 41 is shown best in FIGS. 6 and 7 where the bottom 44 of the Allen screw 43 abuts the bottom of a slot 45 cut into the sliding pin block disc 41. This expands the outer circumference of the disc 41 against the pin slide 39 and securely holds the disc 41 in place. The frictional contact is around such a large surface of the disc 41 that it does not dent or mar the inner surface of the pin slide 39, thus, permitting the numerous adjustments of the individual sight pins 23 without a tendency to fall into a previous position.

Another feature of the present bowsight assembly is its ability to be reassembled in a desired and consistent position. Thus, if an archer disassembles the sight, he can readily reposition it in a desired position. This is accomplished by several sets of indicia. One set of indicia 47 is formed along the bracket cross piece 13 to position it as the assembly is moved back and forth in the direction of the arrow 27' in FIG. 1. Thus, the indicia 47 is read against the bracket member 11. A set of vertical indicia 48 is formed along the inner edge 28 of the inner frame member 18, as shown best in FIGS. 3 and 5, so that the position of the bowsight 10 as it is moved in the direction of arrow 27 may be ascertained. A set of semi-circular indicia 49 can be used to determine angular positions, as shown in FIG. 2.

The bowsight 10 of the present invention is thus a very compacts durable and completely adjustable assembly which is not easily dislocated by the inadvertent contact of the bowsight 10 with underbrush and the like. It provides the option of a pin setup or a crosshair setup and is very easily adjusted in small increments by the combination of the ball bearing 37 and the detents 38. It furthermore may be locked in a desired position against inadvertent movement.

Figure 8:
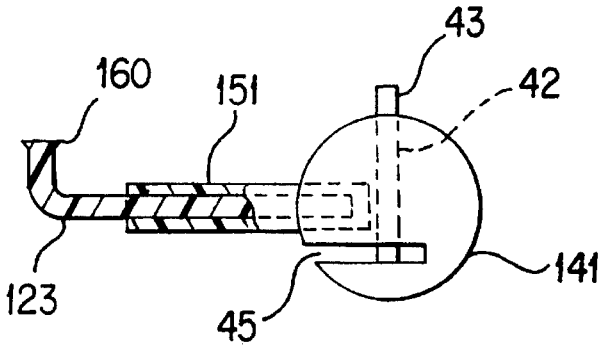
FIG. 8 is a partial cross-sectional view of a transparent pin block disc, a sleeve, and a light-emitting pin, according to one preferred embodiment of this invention.

FIG. 8 shows a top view of the transparent pin block disc 141 and a partial cross-sectional view of a sleeve 151 and a light-emitting pin 123 according to another preferred embodiment of this invention. The sleeve 151 is positioned in a bore of the pin block disc 141. The sleeve 151 preferably comprises a plastic material and can be fixedly or removably secured in the pin block disc 141. The light-emitting pin 123 is removably secured in the sleeve 151, such as by an interference fit formed by the sleeve 151 that receives the light-emitting pin 123 having a slightly smaller diameter than the diameter of the light-emitting pin 123. Thus, the sleeve 151 closely grips the light-emitting pin 123 to prevent rotation or removal of the light-emitting pin 123 while an archer carries the archery bow. However, applying a sufficient force can result in removal of the light-emitting pin 123 from the sleeve 151. Thus, for example, an archer can replace a red colored light-emitting pin 123 with a yellow colored light-emitting pin 123 without any special tools.

The light-emitting pin 123 preferably comprises a fiber optic material, or any material known to those skilled in the art which, when shaped as an elongated element, collects surrounding light and emits the light through another portion of the element, such as an end or a pin head 160, as shown in FIG. 8. Thus, the pin head 160 provides a very luminous reference point for an archer. According to one preferred embodiment of this invention, the pin head 160 has a mushroom head or a larger diameter than the body of the light-emitting pin 123 to allow a relatively large luminous reference point from a relatively small diameter body of the light-emitting pin 123.

Figure 9:
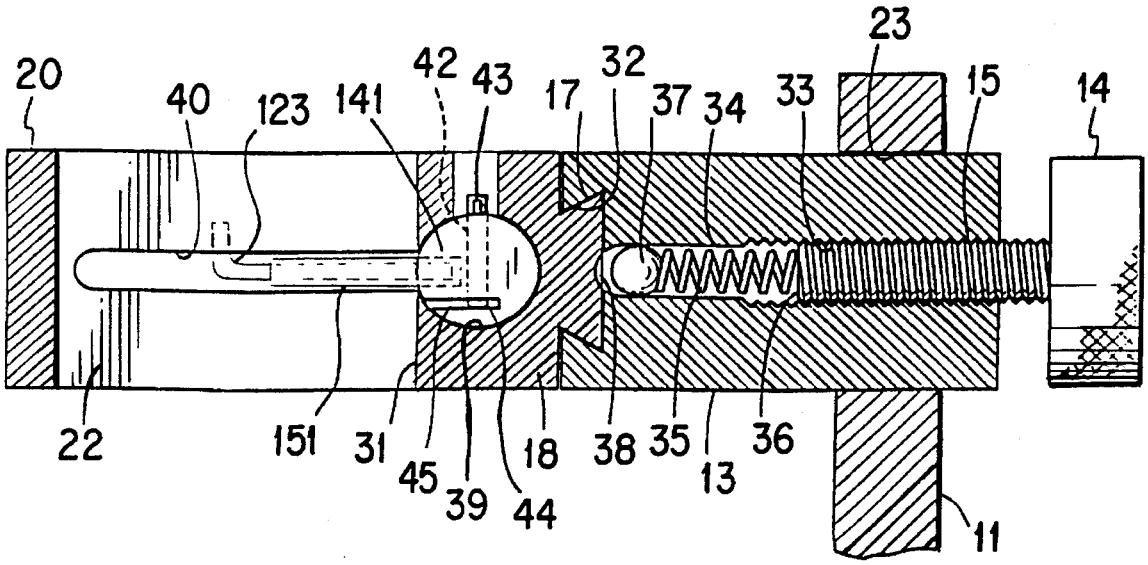
FIG. 9 is a partial cross-sectional view taken along line 6—6 of FIG. 1 showing the dovetail attachment of the bowsight in an unlocked position, according to another preferred embodiment of this invention.

As shown in FIG. 9, the transparent pin block disc 141 is slidably positioned in the pin slide 39. The pin block disc 141 effectively collects surrounding light and directs it to the light-emitting pin 123.

Figure 10:
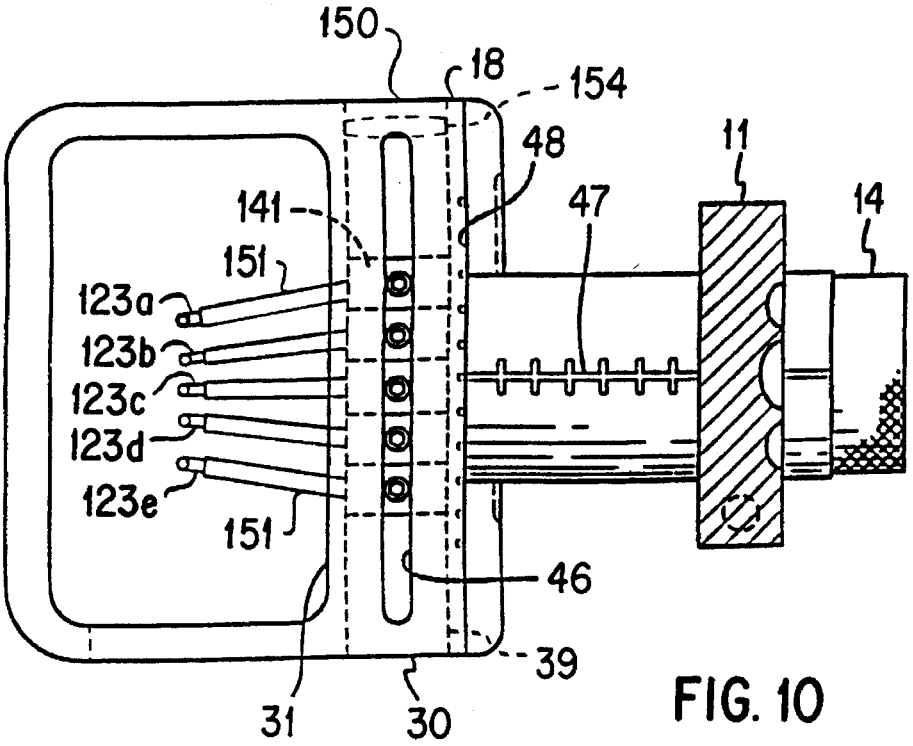
FIG. 10 is a partial cross-sectional view taken along line 3—3 of FIG. 1, according to another preferred embodiment of this invention.

As shown in FIG. 10, the pin slide 39 can extend to the top of the inner frame member 18 to form a bore 150. The pin block disc 141 collects surrounding light entering the bore 150 and transmits the light to the light-emitting pin 123*a*, for example. According to one preferred embodiment of this invention, a lens 154 can be positioned in the pin slide 39 to focus and direct concentrated surrounding light on the pin block discs 141. A reflecting member, not shown, can be positioned in the pin slide 39 to reflect additional surrounding light.

The light-emitting pins 123*a*–123*e* can comprise different colors of transparent or translucent material, and are field replaceable. The pin head 160 of the light-emitting pins 123*a*–123*e* can comprise different shapes, such as circular, rectangular or triangular shapes, and can have different diameters with respect to each other. Thus, a variety of colors, sizes and shapes of the pin heads 160 can enable an archer to quickly discriminate among various pin settings.

Figure 11:
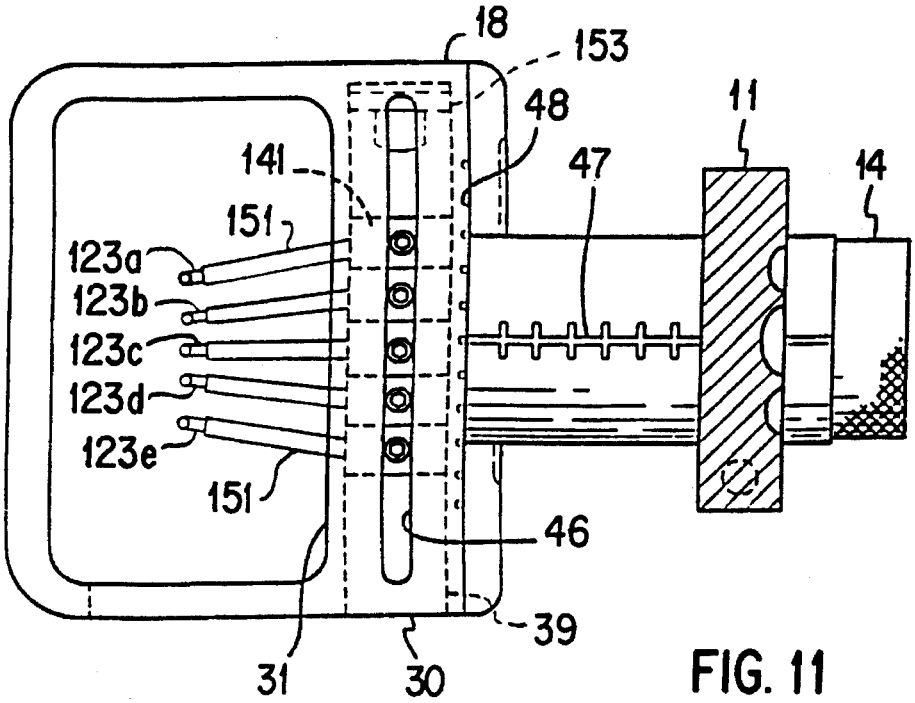
FIG. 11 is a partial cross-sectional view taken along line 3—3 of FIG. 1, according to still another preferred embodiment of this invention.

FIG. 11 shows a bowsight according to another preferred embodiment of this invention. A light-emitting diode 153 is positioned in the pin slide 39. The light-emitting diode 153 provides additional surrounding light for the pin block discs 141 and the light-emitting pins 123*a*–123*e* even in relatively low-light conditions, such as overcast days, or at night. The light-emitting diode 153 can be operated by a switch, not shown, that projects through inner frame member 18. It is apparent that other external energy-supplied lights known to those skilled in the art can be used in place of light-emitting diode 153.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

We claim:

1. A bowsight for an archery bow comprising:

a support frame, mounting means for detachably and adjustably mounting said support frame with respect to the archery bow;

said support frame forming a channel, said channel forming a first through slot and a second through slot; and at least one pin block disc, a light-emitting pin corresponding to each said pin block disc, pin mount means for mounting said light-emitting pin with respect to a corresponding said at least one pin block disc, securement means for adjustably securing said at least one pin block disc with respect to said support frame, light-collecting means for collecting light from a light source and directing said light to said at least one pin block disc, and each said light-emitting pin extending through said first through slot.

2. A bowsight according to claim 1, wherein said light-emitting pin comprises a fiber optic pin.

3. A bowsight according to claim 1, wherein said light-collecting means comprise each said pin block constructed of at least one of a transparent material and a translucent material.

4. A bowsight according to claim 3, wherein said light-collecting means further comprise an optic lens mounted with respect to said support frame so that light is directed into said channel.

5. A bowsight according to claim 3, wherein said light-collecting means further comprise an artificial light source mounted with respect to said support frame so that artificial light is directed into said channel.

6. A bowsight according to claim 5, wherein said artificial light source comprises a light-emitting diode.

7. A bowsight according to claim 1, wherein said pin mount means comprise a sleeve mounted with respect to a corresponding said at least one pin block disc, said sleeve extending through said first through slot, and said light-emitting pin slidably mounted within said sleeve.

8. A bowsight according to claim 1, wherein said securement means comprise said pin block disc forming a lock bore and an elongated slot, said lock bore extending into said elongated slot, said elongated slot extending to an edge of said pin block disc, a lock screw threadedly engageable with said lock bore, and said lock screw accessible through said first through slot.

9. A bowsight according to claim 8, wherein in a secured position of said pin block disc with respect to said support frame an end of said lock screw extends into said elongated slot and abuts a surface of said pin block disk urging a portion of said pin block disk against said support frame.

10. A bowsight according to claim 1 wherein said mounting means include a slide attachment comprising:

a first slide member positioned on said support frame, said first slide member having a plurality of detents;

a second slide member slidably engaging said first slide member, said second slide member having a longitudinal throughbore;

a ball bearing positioned in said longitudinal throughbore and engageable with one of said detents;

a spring positioned in said longitudinal throughbore; and an adjustment member threadedly engageable in said longitudinal throughbore for adjusting a bias force of said spring against said ball bearing.

* * * * *